US008546676B2

(12) United States Patent
Hashimoto

(10) Patent No.: US 8,546,676 B2
(45) Date of Patent: Oct. 1, 2013

(54) PEDAL DEVICE FOR ELECTRONIC PERCUSSION INSTRUMENT

(75) Inventor: Ryuji Hashimoto, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 219 days.

(21) Appl. No.: 13/237,695

(22) Filed: Sep. 20, 2011

(65) Prior Publication Data

US 2012/0073425 A1 Mar. 29, 2012

(30) Foreign Application Priority Data

Sep. 29, 2010 (JP) ..... 2010-218665

(51) Int. Cl.
*G10H 1/00* (2006.01)

(52) U.S. Cl.
USPC ..... 84/721; 84/746; 84/422.1; 84/422.2; 74/478; 74/478.5

(58) Field of Classification Search
USPC ..... 84/422.1, 721, 422.2, 746; 74/478, 74/478.5, 512–514
See application file for complete search history.

(56) References Cited

U.S. PATENT DOCUMENTS

| | | | | | |
|---|---|---|---|---|---|
| 2,532,861 | A | * | 12/1950 | Siever | 74/542 |
| 2,534,939 | A | * | 12/1950 | Alkire | 338/153 |
| 2,893,284 | A | * | 7/1959 | Washington, Jr. | 84/422.1 |
| 2,986,953 | A | * | 6/1961 | De Armond et al. | 74/478 |
| 3,510,566 | A | * | 5/1970 | McKenzie | 84/746 |
| 3,560,629 | A | * | 2/1971 | Tucci | 74/478 |
| 3,663,735 | A | * | 5/1972 | Evans | 84/721 |
| 3,894,445 | A | * | 7/1975 | Rowe | 74/512 |
| 4,006,441 | A | * | 2/1977 | Goodrich | 338/153 |
| 4,200,025 | A | * | 4/1980 | Currier | 84/422.1 |
| 4,744,279 | A | | 5/1988 | Livingston | |
| 4,817,485 | A | * | 4/1989 | Bozzio et al. | 84/746 |

(Continued)

FOREIGN PATENT DOCUMENTS

| | | | |
|---|---|---|---|
| CN | 101197127 | A | 6/2008 |
| CN | 201590240 | U | 9/2010 |
| JP | 6-095672 | A | 4/1994 |
| JP | 2008-145464 | A | 6/2008 |

OTHER PUBLICATIONS

Chinese Office Action mailed Sep. 14, 2012, for CN Patent Application No. 201110272060.5, with English Translation, 12 pages.

(Continued)

*Primary Examiner* — David S. Warren
(74) *Attorney, Agent, or Firm* — Morrison & Foerster LLP

(57) ABSTRACT

A pedal device for an electronic percussion instrument, including: a base; a foot board supported at its first end portion to the base and configured to pivot by depression; an arm rotatably supported at its first end at a pivot point located near to a second end portion of the foot board, the arm being pivotable about the pivot point; a mass portion provided near to a second end of the arm; a regulating portion for regulating a locus of displacement of the mass portion when the foot board is moved from a depression start position to a depression end position; and a stopper portion provided on the base for defining the depression end position by contacting the mass portion in a forward stroke of depression, the regulating portion regulating the locus of the displacement of the mass portion so as not to contain a downward component in the forward stroke.

10 Claims, 6 Drawing Sheets

(56) References Cited

U.S. PATENT DOCUMENTS

| | | | | |
|---|---|---|---|---|
| 4,958,549 | A * | 9/1990 | Vukovic | 84/422.1 |
| 4,976,166 | A * | 12/1990 | Davis et al. | 74/512 |
| 5,044,478 | A * | 9/1991 | Kaesgen et al. | 192/220.1 |
| 5,237,891 | A * | 8/1993 | Lundberg et al. | 74/560 |
| 5,301,592 | A * | 4/1994 | Johnston | 84/422.1 |
| 5,529,296 | A * | 6/1996 | Kato et al. | 267/155 |
| 5,659,145 | A * | 8/1997 | Weil | 84/464 R |
| 5,866,830 | A * | 2/1999 | Onyszkanycz | 84/422.1 |
| 6,369,308 | B1 * | 4/2002 | Orr | 84/422.1 |
| 6,478,719 | B2 * | 11/2002 | Chen | 482/52 |
| 6,590,147 | B2 * | 7/2003 | Kassabian | 84/422.1 |
| 6,689,945 | B1 * | 2/2004 | Matsuzoe et al. | 84/422.1 |
| 6,979,770 | B2 * | 12/2005 | Hampton, Jr. | 84/723 |
| 7,012,203 | B2 * | 3/2006 | Hanson et al. | 200/86.5 |
| 7,119,264 | B2 * | 10/2006 | Van Dyk | 84/422.1 |
| 7,470,847 | B2 * | 12/2008 | Kitagawa | 84/422.1 |
| 8,373,052 | B2 * | 2/2013 | Yoshino | 84/411 M |
| 2002/0056357 | A1 * | 5/2002 | Kassabian | 84/422.1 |
| 2002/0098950 | A1 * | 7/2002 | Chen | 482/52 |
| 2003/0047434 | A1 * | 3/2003 | Hanson et al. | 200/86.5 |
| 2003/0159563 | A1 * | 8/2003 | Shigenaga | 84/422.1 |
| 2006/0060062 | A1 * | 3/2006 | Dyk | 84/422.1 |
| 2008/0098873 | A1 * | 5/2008 | Kitagawa | 84/422.1 |
| 2010/0313700 | A1 * | 12/2010 | Mannle | 74/512 |
| 2012/0031253 | A1 * | 2/2012 | Yoshino | 84/422.1 |
| 2012/0073425 | A1 * | 3/2012 | Hashimoto | 84/746 |
| 2012/0144976 | A1 * | 6/2012 | Johnston et al. | 84/422.1 |
| 2012/0222542 | A1 * | 9/2012 | Hashimoto | 84/746 |

OTHER PUBLICATIONS

European Search Report mailed Oct. 15, 2012, for EP Patent Application No. 11182086.6, four pages.

* cited by examiner

PEDAL DEVICE FOR ELECTRONIC PERCUSSION INSTRUMENT

CROSS REFERENCE TO RELATED APPLICATION

The present application claims priority from Japanese Patent Application No. 2010-218665, which was filed on Sep. 29, 2010, the disclosure of which is herein incorporated by reference in its entirety.

BACKGROUND OF THE INVENTION

1. Field of the Invention

The present invention relates to a pedal device for an electronic percussion instrument.

2. Discussion of Related Art

There is conventionally known a pedal device for an electronic percussion instrument. In one known pedal device, a foot board is pivotably supported on the base, and a weight is provided at a free end of the foot board. Further, a tension coil spring is provided at the free end of the foot board. The known pedal device aims at achieving a depression feeling close to that of an acoustic drum owing to an inertial force by the weight and a load increase by the tension coil spring at a time when the foot board is depressed or stepped on.

SUMMARY OF THE INVENTION

In the known pedal device described above, however, the weight is provided at the foot board. Accordingly, the weight needs to be disposed so as not to hinder the operation of the foot board, and therefore there are various constraints in terms of the size and configuration of the weight. In addition, a displacement amount of the weight depends on a displacement amount of a portion of the foot board to which the weight is attached. In the arrangement, therefore, a degree of freedom in adjustment of the inertial force by the weight is low, and it is not easy to design so as to obtain a desired inertial force. Hence, there is room for improvement in making the depression feeling more natural.

In the known pedal device described above, when the foot board is depressed, the foot board comes into contact with the base, and a depression end position of the foot board is regulated or defined. On this occasion, an impact in a downward direction is applied to the floor surface via the base, causing a vibration and an impact sound. In an electronic drum, in particular, such vibration and impact sound are felt as a nuisance, as compared with an acoustic drum. Further, the feeling at a time of depression end in the electronic drum differs from that in the acoustic drum, thus leaving room for improvement.

The present invention has been made to solve the conventionally experienced problems described above. It is therefore an object of the invention to provide a pedal device for an electronic percussion instrument in which an impact on a floor surface is mitigated and a degree of freedom for improving a depression feeling is enhanced.

To achieve the object indicated above, the present invention provides a pedal device for an electronic percussion instrument, comprising:

a base (10) placed on a floor surface (26);

a foot board (20) supported at a first end portion (20*a*) thereof with respect to the base and configured to pivot by a depressing operation;

an arm (21) rotatably supported at a first end (21*a*) thereof at a pivot point (23) which is located at a position of the foot board near to a second end portion (20*b*) of the foot board, the arm being configured to be pivotable about the pivot point;

a mass portion (22) provided at a position of the arm near to a second end (21*b*) of the arm;

a regulating portion (14*a*; 50*a*; 51*a*) configured to regulate a locus of displacement of the mass portion when the foot board is moved from a depression start position to a depression end position; and a stopper portion (30) provided on the base and configured to define the depression end position of the foot board by contacting the mass portion in a forward stroke of depression of the foot board, wherein the regulating portion is configured to regulate the locus of the displacement of the mass portion so as not to contain a downward component in the forward stroke of depression of the foot board.

The reference numerals in the brackets attached to respective constituent elements of the device in the above description correspond to reference numerals used in the following embodiments to identify the respective constituent elements. The reference numerals attached to each constituent element indicates a correspondence between each element and its one example, and each element is not limited to the one example.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which.

SUMMARY OF THE INVENTION

There will be described embodiments of the invention with reference to the drawings.

Figure 1A:
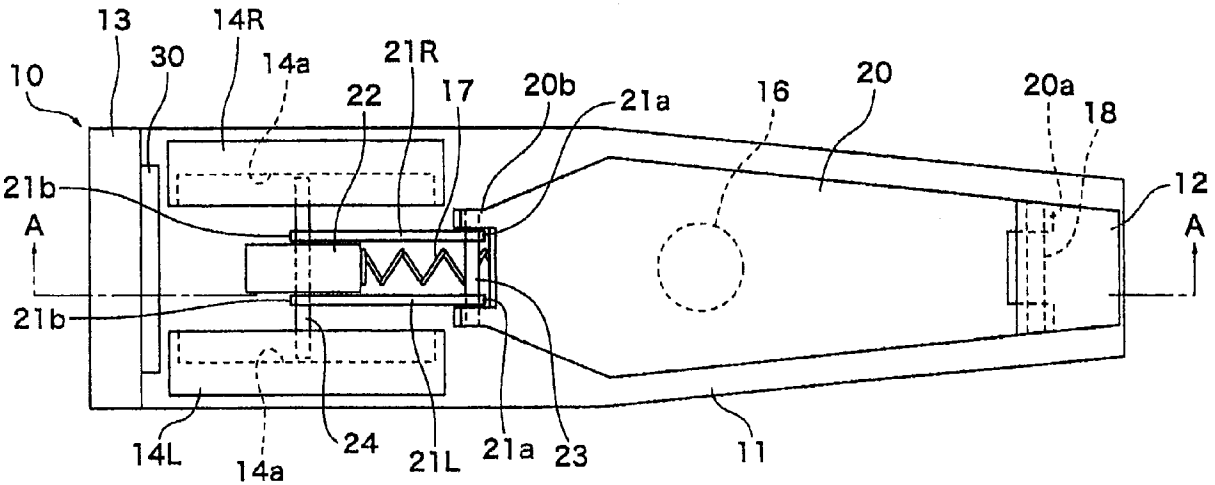
FIGS. 1A and 1B are a plan view and a bottom view, respectively, of a pedal device for an electronic percussion instrument according to one embodiment of the invention.
Figure 1B:
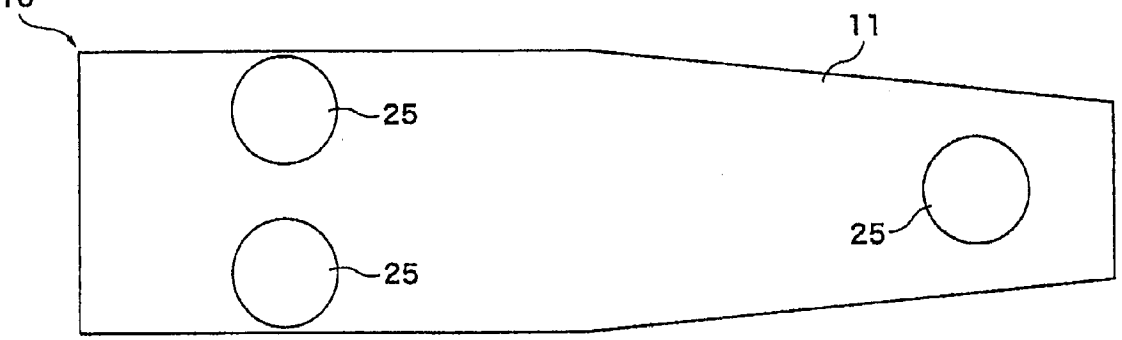
Figure 2A:
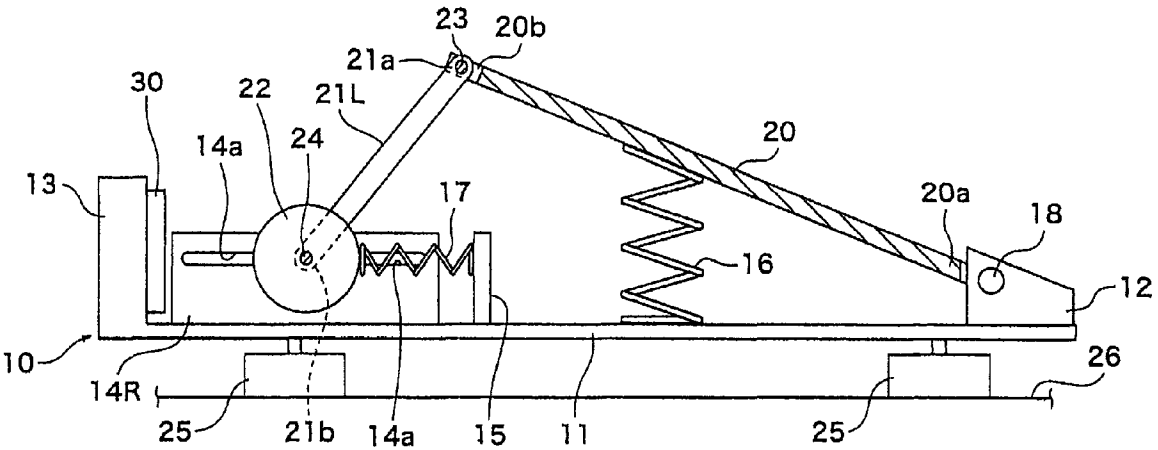
FIGS. 2A and 2B are cross-sectional views taken along line A-A in FIG. 1A.
Figure 2B:
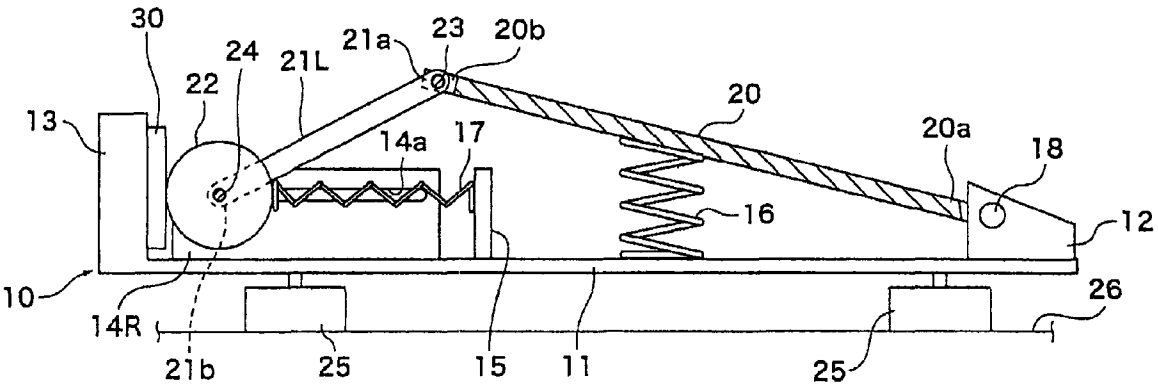

FIGS. 1A and 1B are a plan view and a bottom view, respectively, of a pedal device for an electronic percussion instrument according to one embodiment of the invention. FIGS. 2A and 2B are cross-sectional views taken along line A-A in FIG. 1A.

The pedal device is constituted as a kick pedal for an electronic bass drum as the electronic percussion instrument. The pedal device is disposed on a floor surface 26 and is operated for performance by depressing or stepping on a foot board 20. FIG. 2A shows a state in which the foot board 20 is in a depression start position (i.e., a non-operating state or an initial state) while FIG. 2B shows a state in which the foot board 20 is in a depression end position (i.e., a depression end state).

Hereinafter, a front-rear direction and an up-down direction of the pedal device are used with reference to a state in which the pedal device is placed on the horizontal floor surface 26, and the right side in FIGS. 1 and 2 corresponds to the front side of the pedal device while the upper side in FIGS. 2A and 2B corresponds to the upper side of the pedal device. Further, a left-right direction is used with reference to a perspective of a player or performer present in the right-side portion of FIG. 1A, and accordingly the upper side in FIG. 1A corresponds to the right side of the pedal device.

As shown in FIGS. 1 and 2, the pedal device includes a base 10. There is disposed, on the base 10, a link mechanism constituted by a plate-like foot board 20 and two arms 21 (21L, 21R). In this link mechanism, a mass portion 22 is configured to slidably move in the front-rear direction, and a so-called slider crank mechanism is employed. (The details will be later explained.) The base 10, the foot board 20, and the arm 21 are formed of a metal or the like.

A support portion 12 is provided on a bottom plate 11 of the base 10 so as to be positioned at a front portion of the bottom plate 11. A stopper support portion 13 is provided on the bottom plate 11 so as to be positioned at a rear portion of the bottom plate 11. Side plate portions 14 (14L, 14R) are provided on the bottom plate 11 so as to extend upward respectively from left-side and right-side sections of the rear portion of the bottom plate 11. A spring support portion 15 is provided at a position of the bottom plate 11 which is substantially middle in the front-rear direction and is central in the left-right direction, so as to extend upward, as shown in FIG. 2. As long as the support portion 12, the stopper support portion 13, the side plate portions 14, and the spring support portion 15 are stationary with respect to the bottom plate 11, these portions 12-15 are not required to be formed integrally with the bottom plate 11. A stopper portion 30 is fixedly provided on a front surface of the stopper support portion 13. Here, the bottom plate 11 and the spring support portion 15 may be both referred to as a stationary portion with respect to the base 10. A position of the bottom plate 11 with respect to the stationary portion may be different from a position of the spring support portion 15 with respect to the stationary portion.

Leg portions 25 are provided on a lower surface of the bottom plate 11. The leg portions 25 rest on the floor surface 26, as shown in FIG. 2. Each leg portion 25 is formed of an elastic body, such as a rubber or a spring, and has a function of interrupting or suppressing transmission of a vibration between the base 10 and the floor surface 26. For effectively interrupting the vibration, there may be interposed a viscoelastic material or there may be provided oil dampers or air dampers, at portions corresponding to the leg portions 25, so as to give a loss to an impact transmitted from the pedal device to the floor surface 26 for promoting vibration attenuation. In this instance, it is preferable to design so as not to cause resonance.

The support portion 12 has a first pivot shaft 18 that extends in the left-right direction, and a front end portion 20*a* (as a first end portion) of the foot board 20 is rotatably supported by the first pivot shaft 18. According to the arrangement, the foot board 20 is configured such that a rear end portion 20*b* (as a second end portion) thereof is pivotable about the first pivot shaft 18 in the up-down direction (i.e., in a clockwise direction and a counterclockwise direction in FIG. 2A).

A second pivot shaft 23 as a pivot point is provided at the rear end portion 20*b* of the foot board 20 so as to extend in the left-right direction. The left arm 21L and the right arm 21R are disposed so as to extend parallel with each other, and a front end 21*a* (as a first end) of each of the arms 21 is rotatably supported by the second pivot shaft 23. According to the arrangement, the arms 21 are configured such that the rear ends 21*b* thereof are pivotable about the second pivot shaft 23 relatively in the up-down direction (i.e., in the clockwise direction and the counterclockwise direction in FIG. 2A). The second pivot shaft 23 may be provided at a position other than the rear end portion 20*b* of the foot board 20. For instance, the second pivot shaft 23 may be provided at a position of the foot board 20 near to the rear end portion 20*b* thereof, which position is in a region of the foot board 20 located more rearward than a middle position of the foot board 20 in the front-rear direction (i.e., the longitudinal direction) of the foot board 20.

A bar-like slide pin 24 extends between the rear end 21*b* of the arm 21L and the rear end 21*b* of the arm 21R. The mass portion 22 is disposed between the arms 21L, 21R. The mass portion 22 is preferably formed of a material having a higher degree of specific gravity than the foot board 20 and the arms 21, for permitting a large mass of a system (a motion system) including the foot board 20, the arms 21, and the mass portion 22 to concentrate on the mass portion 22. The slide pin 24 penetrates the mass portion 22 and is rotatable relative to the mass portion 22. While the mass portion 22 has a circular shape in side view in the present embodiment, the mass portion 22 may have a shape other than the circle. The mass portion 22 may be disposed at a position of the arms 21L, 21R other than the rear ends 21*b* thereof. For instance, the mass portion 22 may be disposed at a position of the arms 21L, 21R near to the rear ends 21*b* thereof, which position is in a region of the arms 21 located more rearward than middle positions of the arms 21 in the front-rear direction (i.e., the longitudinal direction) of the arms 21.

A concave guide groove 14*a* is formed in an inside surface in the left-right direction of each of the side plate portions 14 of the base 10, such that the guide groove 14*a* extends along the front-rear direction. The slide pin 24 is disposed so as to extend between the side plate portions 14 along the left-right direction, such that the left end and the right end of the slide pin 24 are held in engagement with a guide groove 14*a* of the side plate portion 14L and a guide groove 14*a* of the side plate portion 14R, respectively. The dimension of each guide groove 14*a* in the up-down direction is slightly larger than a diameter of the slide pin 24, and the slide pin 24 is slidaly movable in the guide grooves 14*a* in the front-rear direction. According to the arrangement, the mass portion 22 is displaceable in the front-rear direction, together with the slide pin 24.

A first coil spring 16, as an elastic member, is interposed between a lower surface of the foot board 20 and the bottom plate 11. The attaching position of the first coil spring 16 to the foot board 20 is preferably near to the rear end portion 20*b* of the foot board 20. But this is not essential. A second coil spring 17, as an elastic member, is interposed between the mass portion 22 and the spring support portion 15. It may be considered that the second coil spring 17 is interposed between the arms 21R, 21L and the spring support portion 15 since the second coil spring 17 transmits its elastic force to the arms 21R, 21L via the mass portion 22 and the slide pin 24. In the non-operating state of the foot board 20, the first coil spring 16 and the second coil spring 17 are both kept in compression state, whereby an equilibrium state of the system of the link mechanism including the foot board 20, the arms 21, and the mass portion 22 is maintained. That is, the foot board 20 in the non-operating state is regulated to be kept at the depression start position shown in FIG. 2A. In other words, the depression start position of the foot board 20 is defined by the elastic forces of the first and second coil springs 16, 17. Further, even where the foot board 20 is displaced, from the depression start position, in a forward direction of depression (i.e., in the counterclockwise direction in FIG. 2A) or in a direction opposite to the forward direction, the foot board 20 receives biasing forces by the coil springs 16, 17 for retuning the foot board 20 back into the depression start position, owing to the elasticity of both of the coil springs 16, 17.

The spring constant, the position, the displacement amount (the deformation amount), etc., of each of the coil springs 16, 17 may be arbitrarily determined, whereby a depression torque of the foot board 20 may be set as desired in accordance with preferences of the performer. Further, the depression start position, i.e., the initial angle, of the foot board 20 may be set as desired. Incidentally, both of the coil springs 16, 17 may be placed in tension state for maintaining the equilibrium state of the system of the link mechanism in the non-operating state.

When a depressing operation of the foot board 20 is started from the non-operating state (FIG. 2A), the foot board 20 rotates or pivots, so that the second pivot shaft 23 displaces downward, causing the slide pin 24 to slide rearward in the guide grooves 14*a* and causing the mass portion 22 to horizontally move or displace. The arms 21 take a posture in accordance with the positions of the second pivot shaft 23 and the slide pin 24. Subsequently, when the mass portion 22 comes into an abutting contact with the stopper portion 30, the foot board 20 is regulated to be placed at the depression end position shown in FIG. 2B. In other words, the depression end position of the foot board 20 is defined by the stopper portion 30. Because a direction in which an impact force of the mass portion 22 directly acts is the rearward direction, the impact force to act in the downward direction toward the floor surface 26 can be considerably reduced. The structure of the stopper portion 30 will be explained.

Figure 3A:
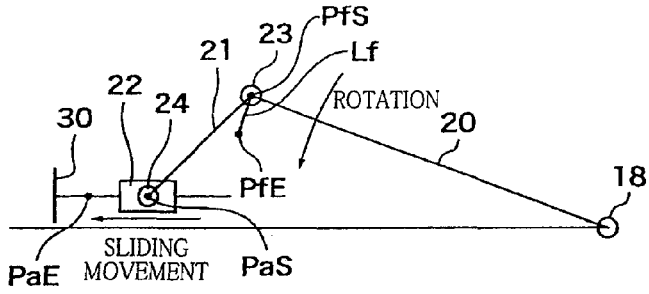
FIG. 3A is a schematic view showing a system of a link mechanism according to the present embodiment and FIGS. 3B-3D are schematic views each showing a system of a link mechanism according to a modified embodiment.

FIG. 3A is a schematic view showing the system of the link mechanism including the foot board 20, the arms 21, and the mass portion 22, according to the present embodiment. Positions of the second pivot shaft 23 and the slide pin 24 in the non-operating state are respectively indicated as a start point PfS and a start point PaS while positions of the second pivot shaft 23 and the slide pin 24 in the depression end position are respectively indicated as an end point PfE and an end point PaE.

In a forward stroke of depression, a linear distance between the start point PaS and the end point PaE of the slide pin 24 is larger than a linear distance between the start point PfS and the end point PfE of the second pivot shaft 23. The displacement amount of the mass portion 22 is larger than the displacement amount of the second pivot shaft 23, whereby an inertial mass of the mass portion 22 in the system is made larger than in a conventional structure in which a mass portion is fixed directly to a foot board. Accordingly, as compared with the conventional structure, it is easier to design such that the influence of the inertial force by the mass portion becomes large. For instance, the linear distance between the start point PaS and the end point PaE of the slide pin 24 may be adjusted by changing the length of the arms 21 so as to change the initial position of the mass portion 22 (i.e., the position of the mass portion 22 in the non-operating state of the foot board 20) or by changing a locus of the sliding movement of the mass portion 22. Further, the degree of freedom in setting the shape and the mass of the mass portion 22 is higher in the present embodiment than in the conventional structure in which the mass portion is fixed to the foot board. In the present embodiment, the mass and the displacement amount of the mass portion 22 are set so as to ensure inertial mass almost equal to that of a kick pedal of an acoustic drum.

Figure 4A:
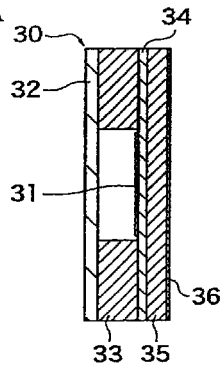
FIGS. 4A and 4B are cross-sectional views schematically showing a structure of a stopper portion according to the present embodiment and FIGS. 4C-4F are cross-sectional views each schematically showing a structure of a stopper portion according to a modified embodiment.
Figure 4B:
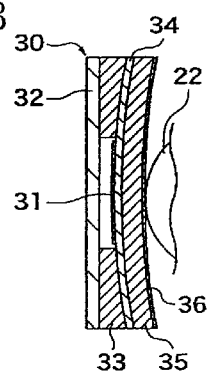

FIGS. 4A and 4B are cross-sectional views schematically showing a detailed structure of the stopper portion 30 according to the present embodiment. While the stopper portion 30 has a circular shape in front view in the present embodiment, the stopper portion 30 may have a rectangular or any other shape. FIG. 4A shows a non-abutting state of the stopper portion 30 and the mass portion 22 while FIG. 4B shows an abutting state of the stopper portion 30 and the mass portion 22. The deformation of the stopper portion 30 is illustrated in an exaggerated manner.

As shown in FIG. 4A, the stopper portion 30 has a base plate 32 at its rearmost section, and a cushioning member 33 such as a sponge is interposed between the base plate 32 and a sensor plate 34. A cushioning member 35 such as a sponge is attached to a front surface of the sensor plate 34, and a rubber sheet 36 covers a front surface of the cushioning member 35. A front surface of the rubber sheet 36 is parallel to the front surface of the cushioning member 35 in the vertical direction. A piezoelectric sensor 31 is attached to a portion of a rear surface of the sensor plate 34 at which the cushioning member 33 is not present.

When the mass portion 22 comes into abutting or pressing contact with or hits on the front surface of the rubber sheet 36, the cushioning members 33, 35 exhibit a cushioning function, and the piezoelectric sensor 31 detects a voltage change in accordance with an impact change of the hit surface by the hitting and outputs a signal. The output signal of the piezoelectric sensor 31 is sent, as a percussion performance trigger signal, to a signal processing portion (not shown) and is converted into percussion performance data or is converted into a sound in real time.

The rubber sheet 36 has hardness higher than that of the cushioning members 33, 35. The rubber sheet 36 and the cushioning members 33, 35 are designed such that there is generated an adequate rebound force which approximates or is close to that of a kick pedal of an acoustic drum at the moment when the mass portion 22 comes into abutting contact with the rubber sheet 36. From a design viewpoint, the rebound force is adjusted mainly by the hardness of the cushioning members 33, 35. The appropriate adjustment enables so-called double performance in which the stopper portion 30 is hit two times successively, without an unnatural or awkward feeling. After the mass portion 22 has rebounded on the stopper portion 30, the system described above returns to the depression start position by the elasticity of the coil springs 16, 17.

In the present embodiment, the link mechanism is constituted by the foot board 20 and the arms 21, and a displacement locus of the mass portion 22 is regulated in the front-rear direction by the guide grooves 14*a*. Thus, the guide grooves 14*a* functions as a regulating portion to regulate the displacement locus of the mass portion. In the forward stroke of depression of the foot board 20, the mass portion 22 slides rearward and comes into contact with the stopper portion 30 from the front, whereby it is possible to mitigate an impact on the floor surface 26. Because the surface of the stopper portion 30 with which the mass portion 22 comes into abutting contact extends in the vertical direction, in particular, the rebound force acts frontward in the horizontal direction, reducing a vibration to be transmitted to the floor surface 26 and an impact sound to be generated. Further, the mass portion 22 is provided at the rear ends 21*b* of the arms 21 linked to the foot board 20, and the displacement amount of the mass portion 22 is larger than that of the rear end portion 20*b* of the foot board 20. Accordingly, it is possible to enlarge the inertial force of the mass portion 22 and to enhance the degree of freedom for improving the depression feeling. Therefore, the depression feeling can be easily improved.

Moreover, the system of the link mechanism is maintained in the equilibrium state, and the return behavior to the initial position is given, owing to the first coil spring 16 and the second coil spring 17. Accordingly, it is possible to achieve an operation feeling in an initial period of depression similar to that of the pedal device of the acoustic drum.

In addition, the cushioning members 33, 35 of the stopper portion 30 serve as a counterforce generating portion for generating, with respect to the foot board 20, a counterforce in a reverse direction away from the stopper portion 30 when the mass portion 22 comes into abutting contact with the stopper portion 30. The arrangement achieves a good hitting feeling and facilitates successive hitting. Here, the reverse direction is a direction opposite to the direction of the displacement of the mass portion 22 at a time when the foot board 20 moves from the depression start position to the depression end position. Further, the stopper portion 30 incorporates the counterforce generating portion and the piezoelectric sensor 31 as a hitting detect mechanism, achieving a good hitting feeling and good detection of the hitting with a compact structure.

From the viewpoint of effectively mitigating the impact with respect to the floor surface 26, the mass portion 22 is configured to displace, in the forward stroke of depression, in a direction in which a downward component is not contained. In the illustrated embodiment, the mass portion 22 is configured to displace, in the forward stroke of depression, only in the rearward direction of the pedal device, as shown in FIGS. 1 and 2. Here, where a direction that coincides with the longitudinal direction of the bottom plate 11 of the base 10 of the pedal device is referred to as the front-rear direction, the rearward direction of the pedal device may be referred to as a direction that coincides with the displacement direction of the mass portion 22 at a time when the foot board 20 moves from the depression start position to the depression end position. The following modified embodiments will be explained as examples in each of which the mass portion 22 displaces, in the forward stroke of depression, in a direction in which the downward component is not contained while displacing rearward or frontward.

Figure 3B:
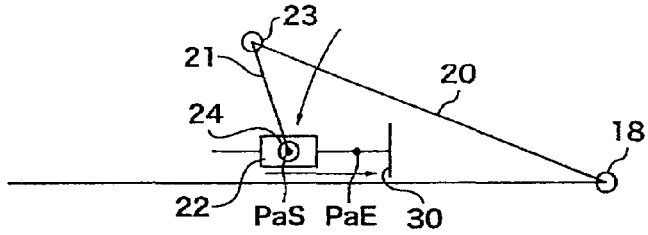
Figure 3C:
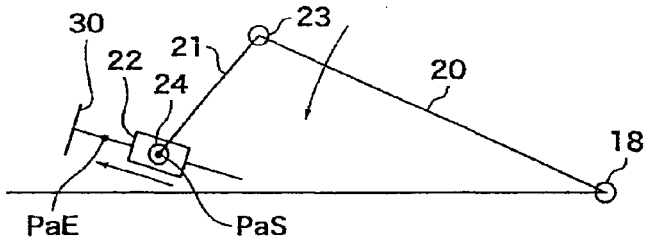
Figure 3D:
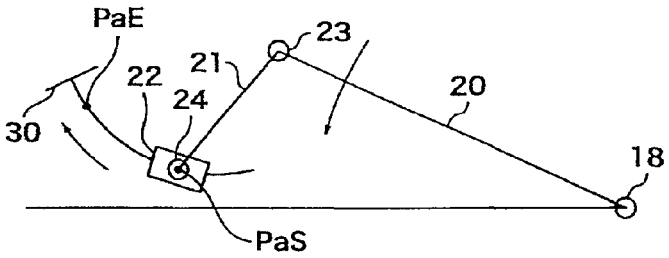

FIGS. 3B-3D are schematic views each of which corresponds to FIG. 3A showing the link mechanism of the illustrated embodiment and which show link mechanisms according to the modified embodiments in each of which the displacement direction of the mass portion 22 is changed. For instance, as shown in FIG. 3B, the mass portion 22 may be configured to slidingly move only in the forward direction as the foot board 20 is depressed. The displacement direction of the mass portion 22 may contain an upward component. As shown in FIG. 3C, the mass portion 22 may be configured to displace along a linear locus while the displacement direction contains rearward and upward components. It is not essential that the mass portion 22 linearly move. As shown in FIG. 3D, the mass portion 22 may be configured to displace along a curved locus while the displacement direction contains the rearward and upward components.

The displacement direction of the mass portion 22 may contain a leftward-rightward component, in addition to the displacement components shown in FIGS. 3A-3D. From the viewpoint of buffering, however, it is possible to effectively mitigate the impact on the floor surface 26 where the horizontal component of the displacement of the slide pin 24 or the mass portion 22 is larger than the upward component of the displacement, in the relationship between the start point PaS and the end point PaE of the slide pin 24. As in the illustrated embodiment of FIG. 3A, it is preferable to design such that the linear distance of the displacement of the mass portion 22 (i.e., the linear distance between the start point PaS and the end point PaE of the slide pin 24) is larger than the linear distance of the displacement of the second pivot shaft 23 by depression of the foot board 20, for permitting the inertial mass to effectively act. Further, in terms of the direction of the rebound force from the stopper portion 30, the plane of the stopper portion 30 with which the mass portion 22 comes into abutting contact is preferably as parallel as possible to the vertical direction.

Figure 4C:
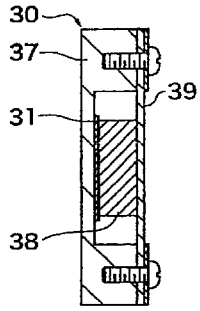
Figure 4D:
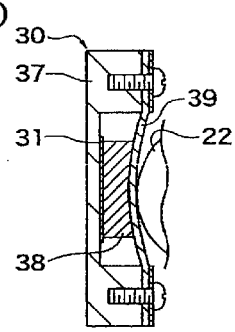

The structure in which the stopper portion 30 incorporates the hitting detect mechanism and the counterforce generating portion is not limited to that shown in FIGS. 4A and 4B. FIGS. 4C-4D show the stopper portions 30 according to modified embodiments.

For instance, in the stopper portion 30 shown in FIGS. 4C and 4D, a film portion 39 is fixed by screws to a base plate 37 such that the film portion 39 maintains tension. Further, a cushioning member 38 such as a sponge is provided on a rear surface of the film portion 39, and the piezoelectric sensor 31 is interposed between the cushioning member 38 and the base plate 37. In the thus constructed stopper portion 30, the rebound force is generated mainly by the tension of the film portion 39. When the mass portion 22 comes into abutting contact with the stopper portion 30, the cushioning member 38 is deformed and the piezoelectric sensor 31 detects the deformation as hitting.

Figure 4E:
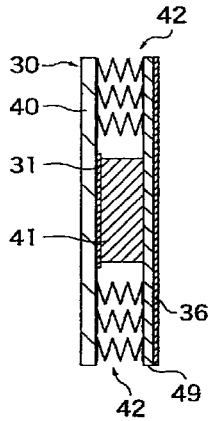
Figure 4F:
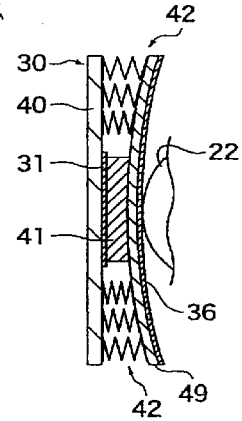

In the stopper portion 30 shown in FIGS. 4E and 4F, a spring 42 is interposed between a base plate 40 and a metal sheet 49. Further, a cushioning member 41 such as a sponge is provided on a front surface of the base plate 40, and the piezoelectric sensor 31 is interposed between the cushioning member 41 and the base plate 40. A front surface of the metal sheet 49 is covered with the rubber sheet 36. In the thus constructed stopper portion 30, the rebound force is generated mainly by elasticity of the spring 42. When the mass portion 22 comes into abutting contact with the stopper portion 30, the cushioning member 41 is deformed and the piezoelectric sensor 31 detects the deformation as hitting.

The counterforce generating portion may be constituted by any elastic member or tension generating member other than those described above, or may be constituted by combination of those members. The kind of the sensor for detecting the hitting is not limited to piezoelectric elements, but any other sensor such as a capacitance sensor or a force sensing resistor sensor may be employed.

The mechanism of regulating the displacement locus of the mass portion 22 is not limited to the illustrated combination of the guide grooves 14*a* and the slide pin 24 shown in FIGS. 1 and 2. Each of the schematic views of FIGS. 5A and 5B shows the mechanism of regulating the displacement locus of the mass portion 22 according to a modified embodiment.

Figure 5A:
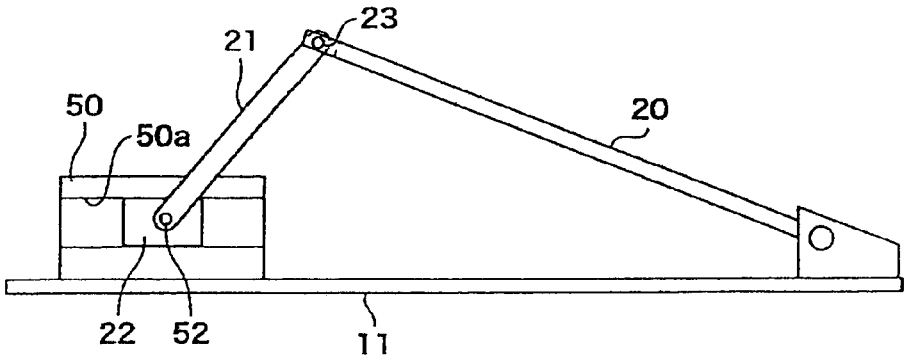
FIGS. 5A and 5B are schematic views each showing a mechanism of regulating a displacement locus of a mass portion according to a modified embodiment.

For instance, as one modified embodiment, side plate portions 50 similar to the side plate portions 14 are disposed at left-side and right-side sections of the bottom plate 11 of the base 10, as shown in FIG. 5A. A concave guide groove 50*a* is formed in an inside surface in the left-right direction of each of the side plate portions 50. The mass portion 22 is formed to have a rectangular parallelepiped shape, and the mass portion 22 and the arms 21 are linked by a pivot shaft 52. The mass portion 22 is configured such that the mass portion 22 itself slides in the guide grooves 50*a* in the front-rear direction.

Figure 5B:
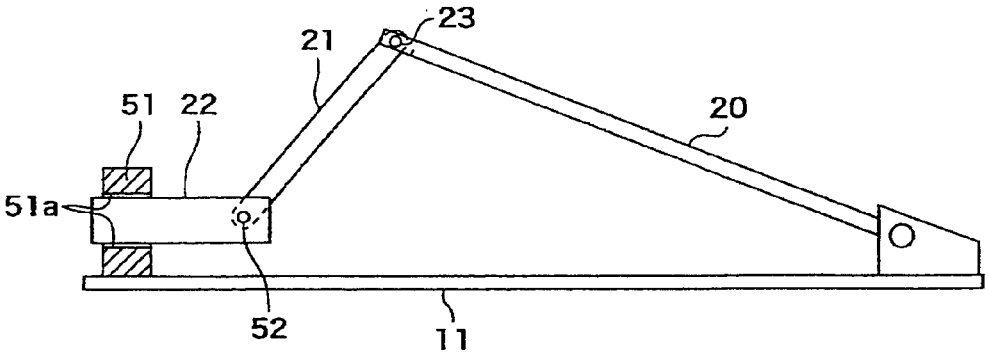

As another modified embodiment, a block 51 is provided on the bottom plate 11 of the base 10 so as to extend upright, and a guide hole 51*a* having a circular shape in front view is formed in the block 51, as shown in FIG. 5B. The mass portion 22 is formed to have a columnar shape, and the mass portion 22 and the arms 21 are linked by the pivot shaft 52. The mass portion 22 is configured such that the mass portion 22 itself slides in the guide hole 51*a* in the front-rear direction.

The layout of the coil springs 16, 17 is not limited to that illustrated in FIGS. 1 and 2 from the viewpoint of maintaining the system of the link mechanism including the foot board 20, the arms 21, and the mass portion 22 in the equilibrium state in the non-operating state. FIGS. 6A-6D show coil spring layouts each for maintaining the system of the link mechanism in the equilibrium state in the non-operating state, according to modified embodiments. In FIGS. 6A-6E, spring retain portions 10*a*-10*e* are stationary portions with respect to the base 10. Accordingly, the spring retain portions 10*a*-10*e* may be portions of the base 10 per se, or may be separate members fixed to the base 10. That is, the stationary portions with respect to the base 10 refer to portions at which a relative positional relationship with respect to base 10 does not change, and the stationary portions include portions of the base 10 and portions separate from the base 10.

Figure 6A:
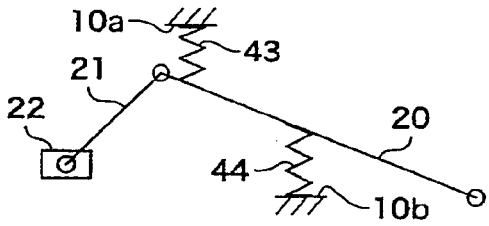
FIGS. 6A-6E are views each showing a coil spring layout for maintaining the system of the link mechanism in an equilibrium state in a non-operating state, according to modified embodiments.
Figure 6B:
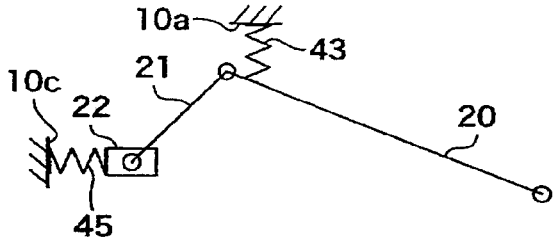

For instance, as one modified embodiment, a coil spring 43 is disposed between the foot board 20 and the spring retain portion 10*a* that is located above the foot board 20 while a coil spring 44 is disposed between the foot board 20 and the spring retain portion 10*b* that is located below the foot board 20, as shown in FIG. 6A. As another modified embodiment, the coil spring 43 is disposed between the foot board 20 and the spring retain portion 10*a* while a coil spring 45 is disposed between the mass portion 22 and the spring retain portion 10*c* that is located rearward of the mass portion 22, as shown in FIG. 6B. As still another embodiment, the coil spring 45 is disposed between the mass portion 22 and the spring retain portion 10*c* while a coil spring 46 is disposed between the mass portion 22 and the a spring retain portion 10*d* that is located frontward of the mass portion 22, as shown in FIG. 6C.

Figure 6C:
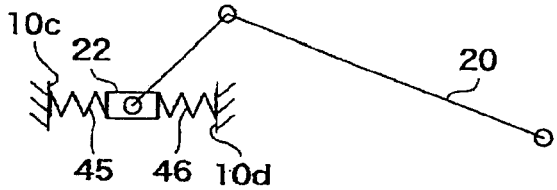

In each of the modified embodiments of FIGS. 6A-6C, the two coil springs are both kept in compression state, whereby the system of the link mechanism can be maintained in the equilibrium state in the non-operating state. Alternatively, it is possible to maintain the system in the equilibrium state by keeping both of the two coil springs in tension state.

Figure 6D:
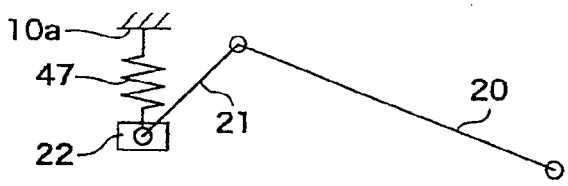

As yet another modified embodiment, a coil spring 47 is disposed between the mass portion 22 and the spring retain portion 10*a* that is located above the mass portion 22, as shown in FIG. 6D. In the non-operating state, the coil spring 47 is kept in tension state, and the mass portion 22 is located right below the spring retain portion 10*a*. As further modified embodiment, a coil spring 48 is disposed between the rear end portion 20*b* of the foot board 20 (or the second pivot shaft 23) and the spring retain portion 10*e* that is located rearward of and obliquely above the rear end portion 20*b*. In the non-operating state, the coil spring 48 is kept in tension state and is located on the extension of the foot board 20.

Figure 6E:
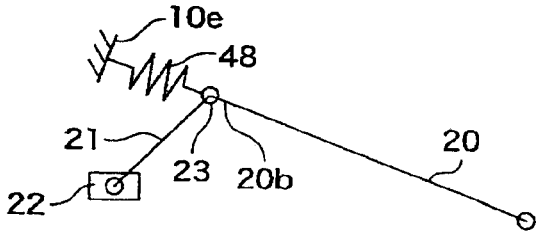

In each of the modified embodiments of FIGS. 6D and 6E, one coil spring is used. Each of the coil springs 47, 48 is disposed in tension state such that the length of each coil spring 47, 48 is the shortest at a time when the foot board 20 is located at the depression start position, in a state in which each coil spring 47, 48 is disposed in the pedal device. Even where the foot board 20 is moved from the depression start position in the non-operating state, in a forward direction of depression or in a direction opposite to the forward direction, each coil spring 47, 48 is pulled so as to extend longer than in the state in which the length of the coil spring 47, 48 is the shortest. As a result, the biasing force of the coil spring for permitting the foot board 20 to return to the depression start position acts on the system of the link mechanism.

In the illustrated embodiment and modified embodiments, for appropriately constituting the system of the link mechanism, the second pivot shaft 23 is located at a position of the foot board 20 near to the rear end portion 20*b* of the foot board 20 while the mass portion 22 is located at a position of the arms 21 near to the rear ends 21*b* of the arms 21. Further, the coil springs such as the coil springs 16, 17 need to exhibit the elastic force, and other elastic members such as a rubber may be used.

The piezoelectric sensor 31 needs to detect directly or indirectly the movement or motion of the foot board 20. Accordingly, the position of the piezoelectric sensor 31 is not limited to the position at which the sensor 31 contacts the mass portion 22, but the sensor 31 may be disposed at a position where the movement of the foot board 20 per se is detectable, such as on the bottom plate 11.

It is to be understood that the present invention may be embodied with various other changes and modifications, which may occur to those skilled in the art, without departing from the spirit and scope of the invention defined in the appended claims.

What is claimed is:

1. A pedal device for an electronic percussion instrument, comprising:

a base placed on a floor surface;

a foot board supported at a first end portion thereof with respect to the base and configured to pivot by a depressing operation;

an arm rotatably supported at a first end thereof at a pivot point which is located at a position of the foot board near to a second end portion of the foot board, the arm being configured to be pivotable about the pivot point;

a mass portion provided at a position of the arm near to a second end of the arm;

a regulating portion configured to regulate a locus of displacement of the mass portion when the foot board is moved from a depression start position to a depression end position; and a stopper portion provided on the base and configured to define the depression end position of the foot board by contacting the mass portion in a forward stroke of depression of the foot board, wherein the regulating portion is configured to regulate the locus of the displacement of the mass portion so as not to contain a downward component in the forward stroke of depression of the foot board.

2. The pedal device according to claim 1, wherein a linear distance between a position (PaS) of the mass portion corresponding to the depression start position and a position (PaE) of the mass portion corresponding to the depression end position is larger than a linear distance between a position (PfS) of the pivot point corresponding to the depression start position and a position (PfE) of the pivot point corresponding to the depression end position.

3. The pedal device according to claim 1, wherein a horizontal component in the locus of the displacement of the mass portion in the forward stroke of depression of the foot board is larger than an upward component in the locus of the displacement, in a relationship between a position (PaS) of the mass portion corresponding to the depression start position and a position (PaE) of the mass portion corresponding to the depression end position.

4. The pedal device according to claim 1, further comprising elastic members interposed respectively between a stationary portion with respect to the base and the foot board and between a stationary portion with respect to the base and the arm, wherein the foot board is located at the depression start position in a non-operating state of the pedal device, owing to elastic forces of the elastic members, and wherein the foot board receives a force by the elastic forces of the elastic members to return the foot board to the depression start position, even where the foot board is moved from the depression start position in a forward direction of depression or in a direction opposite to the forward direction.

5. The pedal device according to claim 1, further comprising at least one elastic member interposed between a stationary portion with respect to the base and the arm in tension state such that a length of the at least one elastic member is the shortest when the foot board is located at the depression start position, wherein the foot board is located at the depression start position in a non-operating state of the pedal device, owing to an elastic force of the at least one elastic member, and wherein the foot board receives a force by the elastic force of the at least one elastic member to return the foot board to the depression start position, even where the foot board is moved from the depression start position in a forward direction of depression or in a direction opposite to the forward direction.

6. The pedal device according to claim 1, further comprising elastic members each of which is interposed between a stationary portion with respect to the base and the foot board and which exert respective forces having mutually different directions on the foot board, wherein the foot board is located at the depression start position in a non-operating state of the pedal device, owing to elastic forces of the elastic members, wherein the foot board receives a force by the elastic forces of the elastic members to return the foot board to the depression start position, even where the foot board is moved from the depression start position in a forward direction of depression or in a direction opposite to the forward direction.

7. The pedal device according to claim 1, further comprising elastic members each of which is interposed between a stationary portion with respect to the base and the arm and which exert respective forces having mutually different directions on the foot board, wherein the foot board is located at the depression start position in a non-operating state of the pedal device, owing to elastic forces of the elastic members, and wherein the foot board receives a force by the elastic forces of the elastic members to return the foot board to the depression start position, even where the foot board is moved from the depression start position in a forward direction of depression or in a direction opposite to the forward direction.

8. The pedal device according to claim 4, wherein one of the elastic members which is interposed between the stationary portion with respect to the base and the arm is configured such that one end thereof is in contact with the stationary portion and another end thereof is in contact with the mass portion.

9. The pedal device according to claim 8, wherein the one of the elastic members which is interposed between the stationary portion with respect to the base and the arm is configured to give, to the mass portion, a force whose direction is the same as a direction of extension of the locus of the displacement.

10. The pedal device according to claim 1, wherein the stopper portion includes a counterforce generating portion configured to generate, with respect to the foot board, a counterforce in a reverse direction by contacting the mass portion, the reverse direction being a direction opposite to a direction of the displacement of the mass portion at a time when the foot board is moved from the depression start position to the depression end position.

* * * * *